US008272691B2

(12) United States Patent
Hsuan-Chin

(10) Patent No.: US 8,272,691 B2
(45) Date of Patent: Sep. 25, 2012

(54) RESILIENT LOWER-BACK SUPPORTING DEVICE CAPABLE OF VERTICAL ADJUSTMENT ALONG WITH BACKREST OF CHAIR

(75) Inventor: Tsai Hsuan-Chin, Chai-Yi Hsien (TW)

(73) Assignee: FUH Shyan Co., Ltd., Chai-Yi Hsien (TW)

( * ) Notice: Subject to any disclaimer, the term of this patent is extended or adjusted under 35 U.S.C. 154(b) by 238 days.

(21) Appl. No.: 12/793,724

(22) Filed: Jun. 4, 2010

(65) Prior Publication Data

US 2011/0298260 A1 Dec. 8, 2011

(51) Int. Cl.
*A47C 3/00* (2006.01)

(52) U.S. Cl. ..... 297/285; 297/284.4; 297/284.7; 297/291; 297/299

(58) Field of Classification Search ..... 297/284.4, 297/284.7, 284.8, 285, 291, 298, 299
See application file for complete search history.

(56) References Cited

U.S. PATENT DOCUMENTS

| | | | | |
|---|---|---|---|---|
| 3,294,442 | A * | 12/1966 | Fliut | 297/298 |
| 4,362,335 | A * | 12/1982 | Drabert et al. | 297/285 X |
| 7,063,384 | B2 * | 6/2006 | Liu | 297/284.4 |
| 7,303,232 | B1 * | 12/2007 | Chen et al. | 297/284.8 |
| 2008/0231095 | A1 * | 9/2008 | Brauning | 297/284.7 |

* cited by examiner

*Primary Examiner* — Anthony D Barfield
(74) *Attorney, Agent, or Firm* — Alan Kamrath; Kamrath IP Lawfirm, PA

(57) ABSTRACT

A resilient lower-back supporting device capable of vertical adjustment along with a backrest of a chair includes a resilient supporting unit pivotally connected between a lower end of the height-adjustable backrest and a supporting element. Configured for resilient extension and retraction, the resilient supporting unit includes an outer supporting rod and an inner supporting rod inserted therein. The two supporting rods are pulled toward each other by a spring provided therebetween. Besides, a spring is provided at an outer end of each supporting rod to bias the resilient supporting unit and the backrest toward a predetermined direction. With the backrest being vertically adjustable, and with the resilient support provided by a lower-back supporting portion at the lower end of the backrest, people of different heights are ergonomically supported especially on the lower back while sitting in the chair and are protected from back pain attributable to a prolonged sitting posture.

4 Claims, 6 Drawing Sheets

RESILIENT LOWER-BACK SUPPORTING DEVICE CAPABLE OF VERTICAL ADJUSTMENT ALONG WITH BACKREST OF CHAIR

FIELD OF THE INVENTION

The present invention relates to a resilient lower-back supporting device capable of vertical adjustment along with a backrest of a chair. More particularly, the present invention relates to a device that not only allows a backrest of a chair to be adjusted vertically, but also includes a resilient supporting unit provided between a lower end of the backrest and a supporting element, so that the resilient supporting unit is extendable as well as retractable to produce a resilient pushing effect by which a lower-back supporting portion of the backrest is pressed resiliently against a sitter's lower back.

DESCRIPTION OF THE PRIOR ART

As people nowadays spend more time in the office than at home, the importance of a comfortable office chair cannot be overstressed. However, sitting in a fixed position for a long time causes low back pain. While some protective waist-belts on the market claim to prevent low back pain, the asserted effects have yet to be proven, and overdependence on such waist-belts may produce adverse effects instead. Therefore, for computer users who wish to prevent low back pain attributable to sitting long hours in a fixed posture, it is crucial to choose appropriate chairs.

Generally, the intervertebral discs of the human lumbar vertebrae are subjected to higher pressure in a sitting posture where the upper body is held upright or leans slightly forward (i.e., with the upper body and the thighs forming an included angle smaller than 90 degrees) than in a standing posture. Hence, sitting in a fixed position (i.e., without change of posture) for a prolonged period leads to fatigue, and this is why people who have sat for a long time would wiggle their bodies to ease the discomfort. The backrest of a chair is designed to support part of a sitter's body weight and relieve stress from the sitter's lumbar vertebrae, thus allowing related muscles to relax. If sufficiently supported by the backrest, the sitter's lower back is less likely to fatigue during work.

However, if the backrest is too far back to contact with and support the sitter's back, or if the backrest is too high or too low, the sitter's lumber vertebrae will not be adequately supported.

SUMMARY OF THE INVENTION

Therefore, in order to overcome the drawbacks of conventional backrests of chairs, such as failure to provide support at the appropriate height to a sitter's back and particularly the lower back, the present invention proposes a chair whose backrest is height-adjustable and has a lower end formed as a lower-back supporting portion for providing resilient support to a sitter's lower back.

The technical solution of the present invention consists in a resilient supporting unit pivotally connected between a supporting element of a chair and a lower-back supporting portion at a lower end of a height-adjustable backrest and which is extensible and retractable to provide a resilient pushing effect. The resilient supporting unit includes an outer supporting rod and an inner supporting rod inserted in the outer supporting rod. The inner and outer supporting rods are pulled toward each other by a spring provided therebetween. In addition, a lower end of the inner supporting rod and an upper end of the outer supporting rod are respectively and pivotally connected to predetermined positions of the supporting element and of the backrest, and the pivotal connection positions are respectively provided with springs for biasing the resilient supporting unit and the backrest toward a predetermined direction.

The backrest of the present invention includes an upper-back supporting portion and the lower-back supporting portion pivotally connected to a lower end of the upper-back supporting portion. The two ends of the resilient supporting unit are respectively and pivotally connected to the supporting element and the lower-back supporting portion.

The present invention is advantageous in that not only is the backrest of the chair capable of being adjusted and positioned according to the desired supporting height so that sitters of different statures can be properly and ergonomically supported, but also the lower-back supporting portion at the lower end of the backrest provides resilient support to a sitter's lower back and hence increases sitting comfort.

BRIEF DESCRIPTION OF THE DRAWINGS

The invention will be better understood and objects other than those set forth above will become apparent when consideration is given to the following detailed description thereof. Such description makes reference to the annexed drawings, wherein.

DETAILED DESCRIPTION OF THE INVENTION

Figure 1:
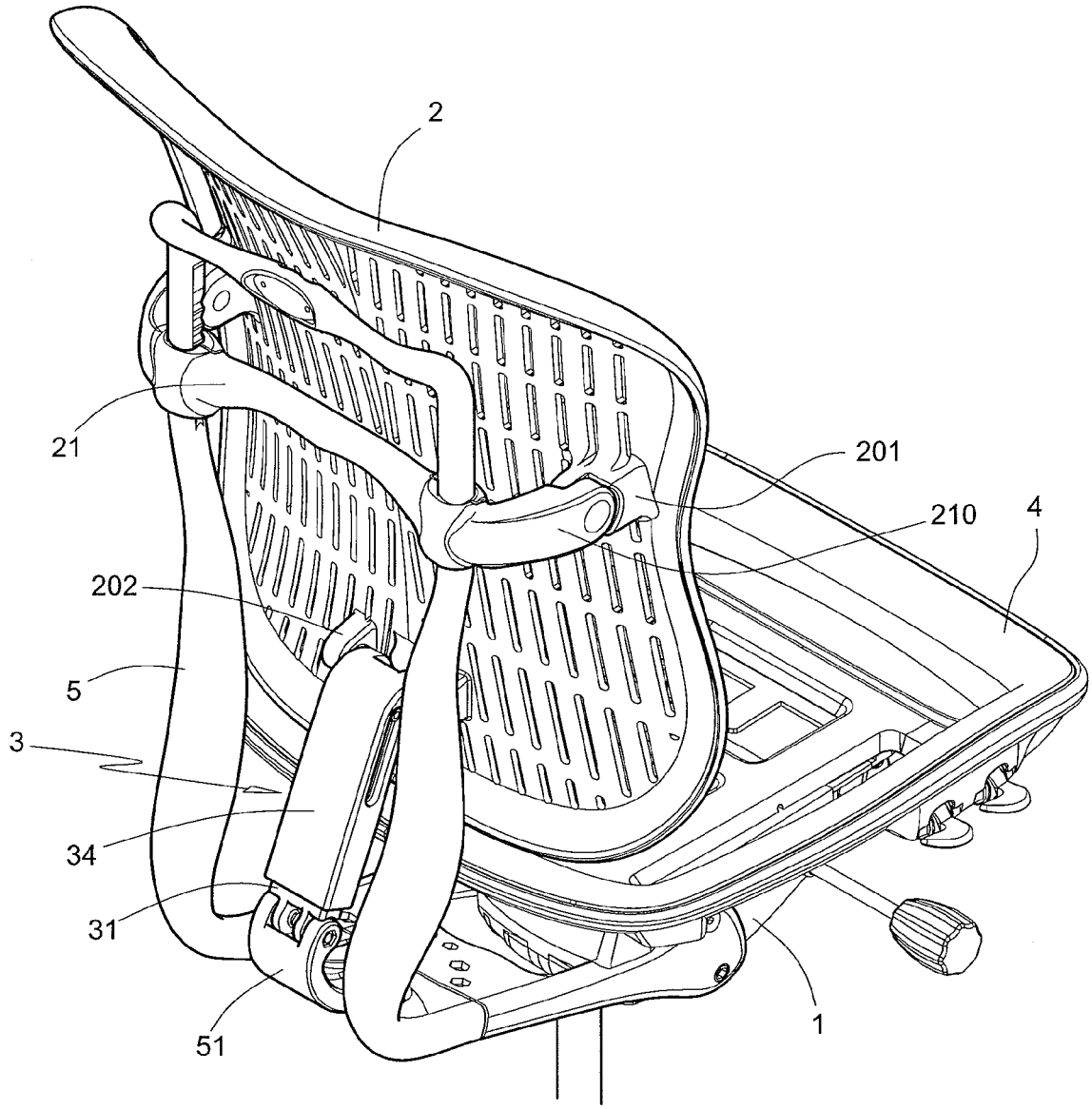
FIG. 1 is a perspective view of the present invention.
Figure 2:
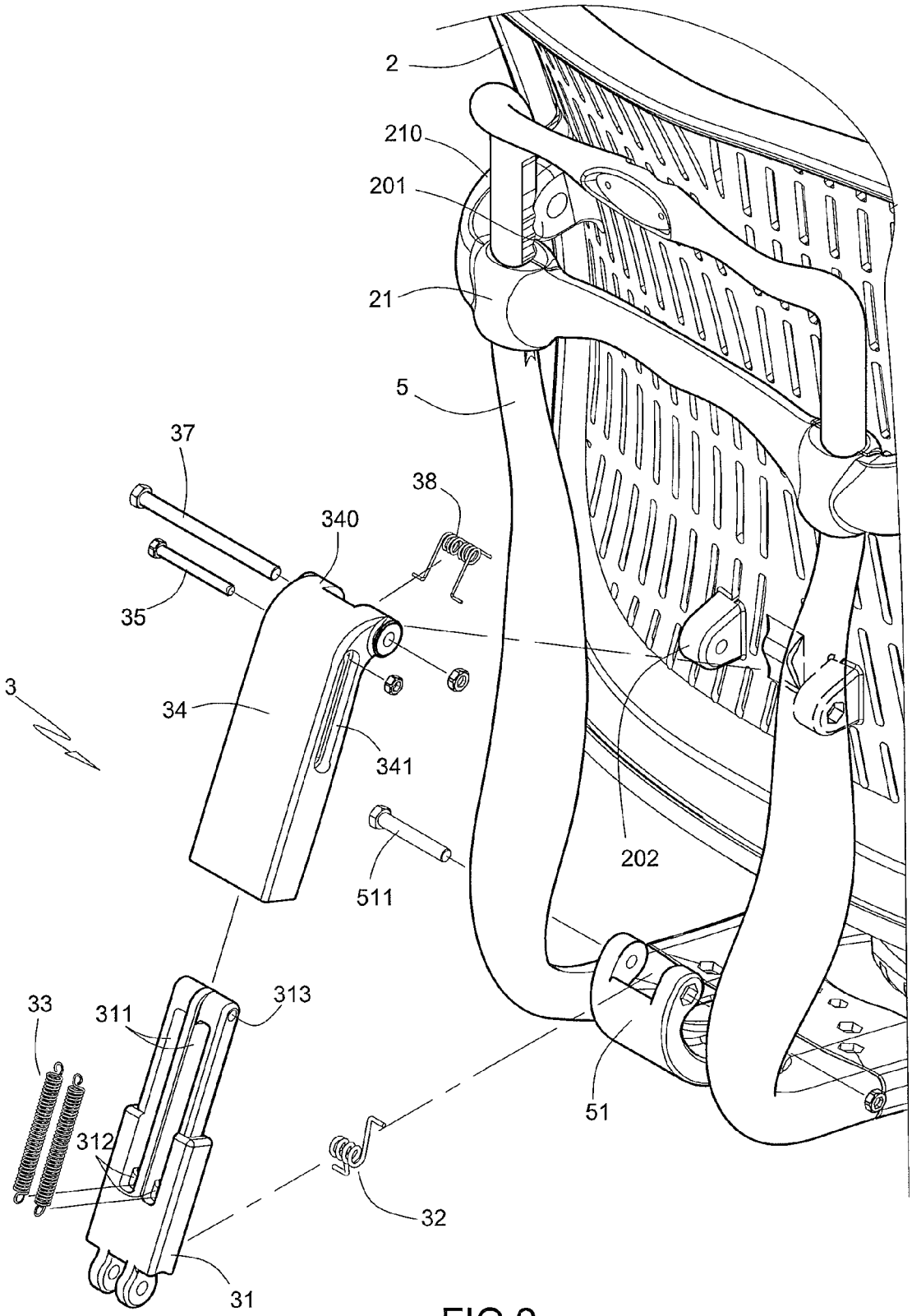
FIG. 2 is an exploded perspective view of a resilient supporting unit at a lower end of a backrest according to the present invention.

Referring to FIG. 1 and FIG. 2, a chair according to the present invention includes a base 1 equipped with a chair leg at the lower end. A seat 4 is connected to the top of the base 1. A supporting element 5 is connected to the back of the base 1 and extends upward. The supporting element 5 is provided with a sliding element 21 which can slide vertically along and be fixed in position to the supporting element 5. Pivotal connecting portions 210 at the two ends of the sliding element 21 are respectively and pivotally connected to pivotal connecting portions 201 provided at corresponding positions on the back of a backrest 2. Besides, a pivotal connecting portion 202 is provided at a predetermined position at the lower end of the back of the backrest 2 (i.e., a lower-back supporting portion that serves to support a sitter's lower back).

Figure 3:
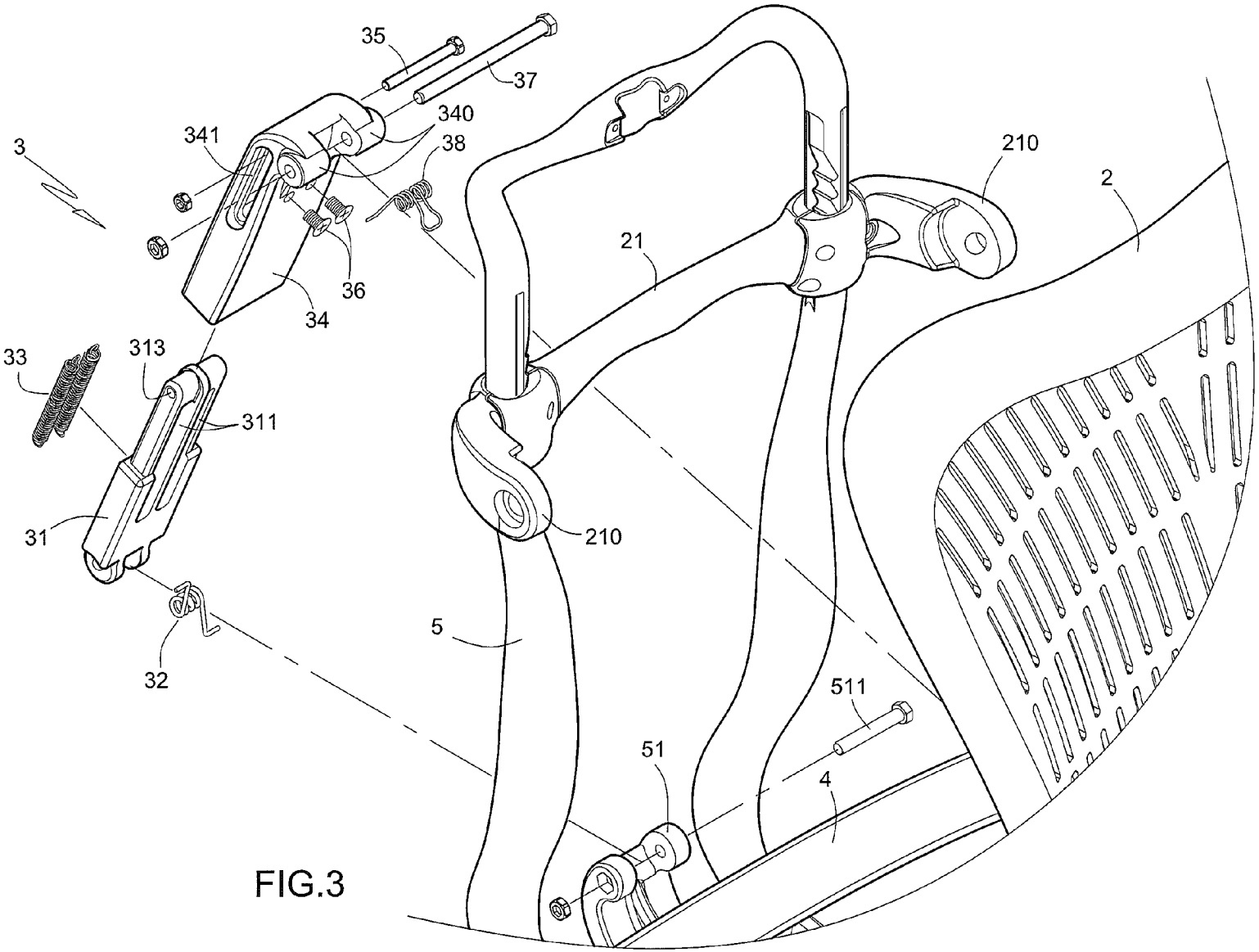
FIG. 3 is another exploded perspective view of the resilient supporting unit at the lower end of the backrest according to the present invention.

As shown in FIG. 3, a pivotal connecting portion 51 is provided at a predetermined position at the lower end of the supporting element 5. A resilient supporting unit 3 is connected between the pivotal connecting portion 202 and the pivotal connecting portion 51. More specifically, the two ends of the resilient supporting unit 3 are respectively and pivotally connected to the pivotal connecting portions 202 and 51. The resilient supporting unit 3 includes an inner supporting rod 31 whose lower end is passed through by a pivot 511 and pivotally connected to the pivotal connecting portion 51 by the pivot 511. A spring 32 is mounted around the pivot 511 to bias the inner supporting rod 31 toward the backrest 2. Grooves 311 are formed in the middle section of the inner supporting rod 31 and configured for receiving springs 33, respectively. The lower ends of the springs 33 are attached to hooks 312, respectively. The inner supporting rod 31 is inserted in a hollow outer supporting rod 34 and can be extended from and retracted into the outer supporting rod 34. The outer supporting rod 34 is laterally provided with a slide groove 341 through which an axle 35 is inserted. The axle 35 also passes through a through hole 313 at the upper end of the inner supporting rod 31. The upper ends of the springs 33 are attached to screws 36 fastened to an upper portion of the outer supporting rod 34, respectively, such that the inner supporting rod 31 and the outer supporting rod 34 are resiliently pulled toward each other by the springs 33. The upper end of the outer supporting rod 34 has a pivotal connecting portion 340 through which a pivot 37 passes. The pivot 37 also passes through the pivotal connecting portion 202 and thereby pivotally connects the pivotal connecting portions 340 and 202. A spring 38 is mounted around the pivot 37 and has two ends pressing resiliently against the outer supporting rod 34 and the backrest 2, respectively.

Figure 4:
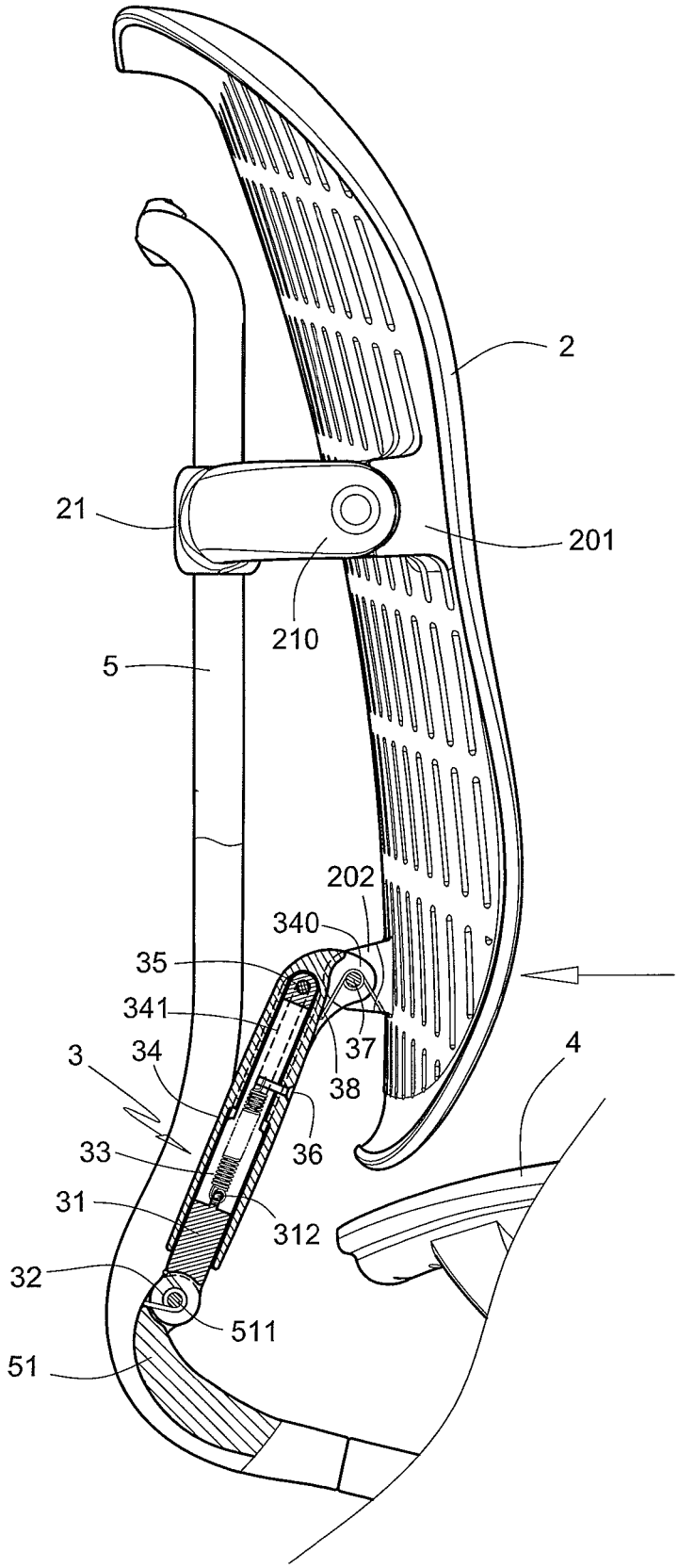
FIG. 4 is a partially sectional view showing operation of the resilient supporting unit according to the present invention.
Figure 5:
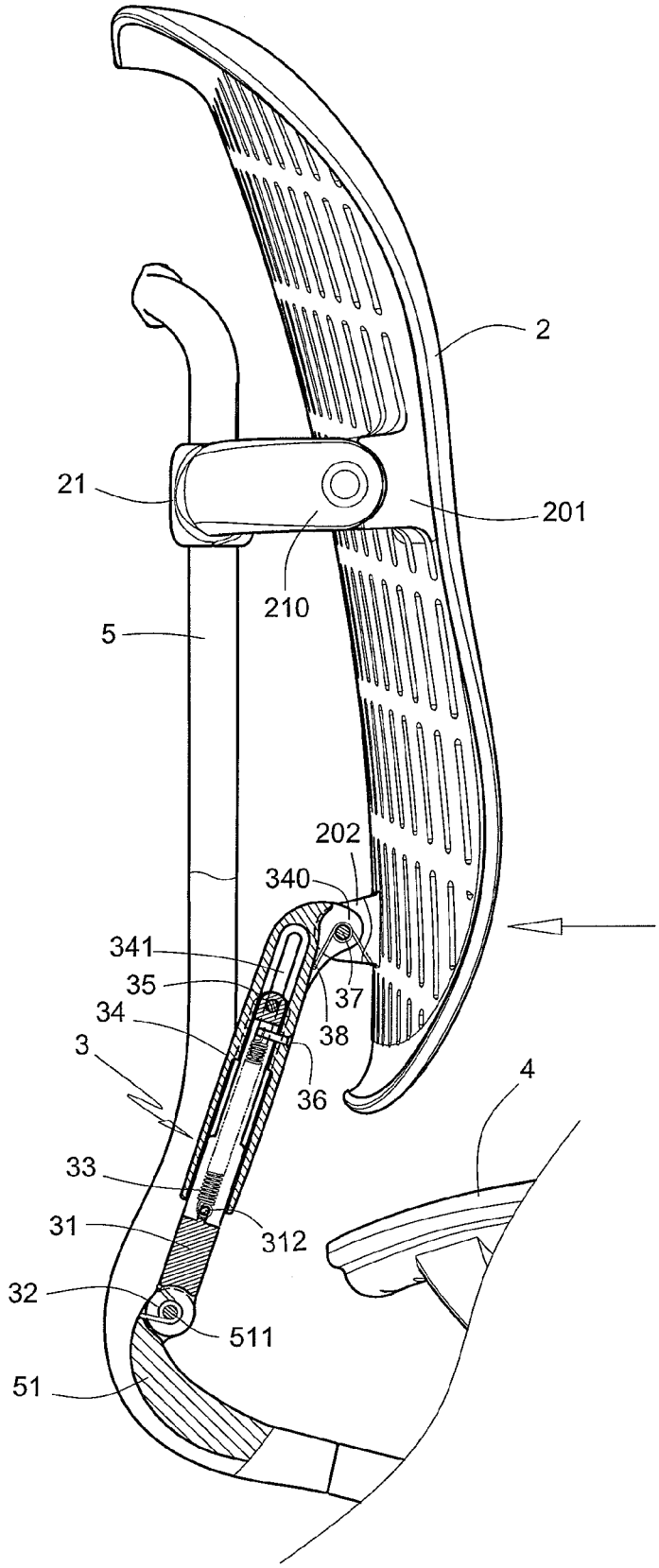
FIG. 5 is another partially sectional view showing operation of the resilient supporting unit according to the present invention.

With reference to FIG. 4 and FIG. 5, the backrest 2 can be adjusted to and positioned at predetermined heights, and while the backrest 2 is moved upward or downward, the inner supporting rod 31 and the outer supporting rod 34 of the resilient supporting unit 3 extend or retract with respect to each other without affecting the adjustment of height of the backrest 2. Once the backrest 2 is adjusted to a predetermined height, the lower-back supporting portion at the lower end of the backrest 2 is at a position suitable for supporting a sitter's lower back. As the springs 32, 38 of the resilient supporting unit 3 produce a resilient pushing effect, the lower-back supporting portion at the lower end of the backrest 2 is pressed resiliently against the sitter's lower back to provide adequate support thereto.

Figure 6:
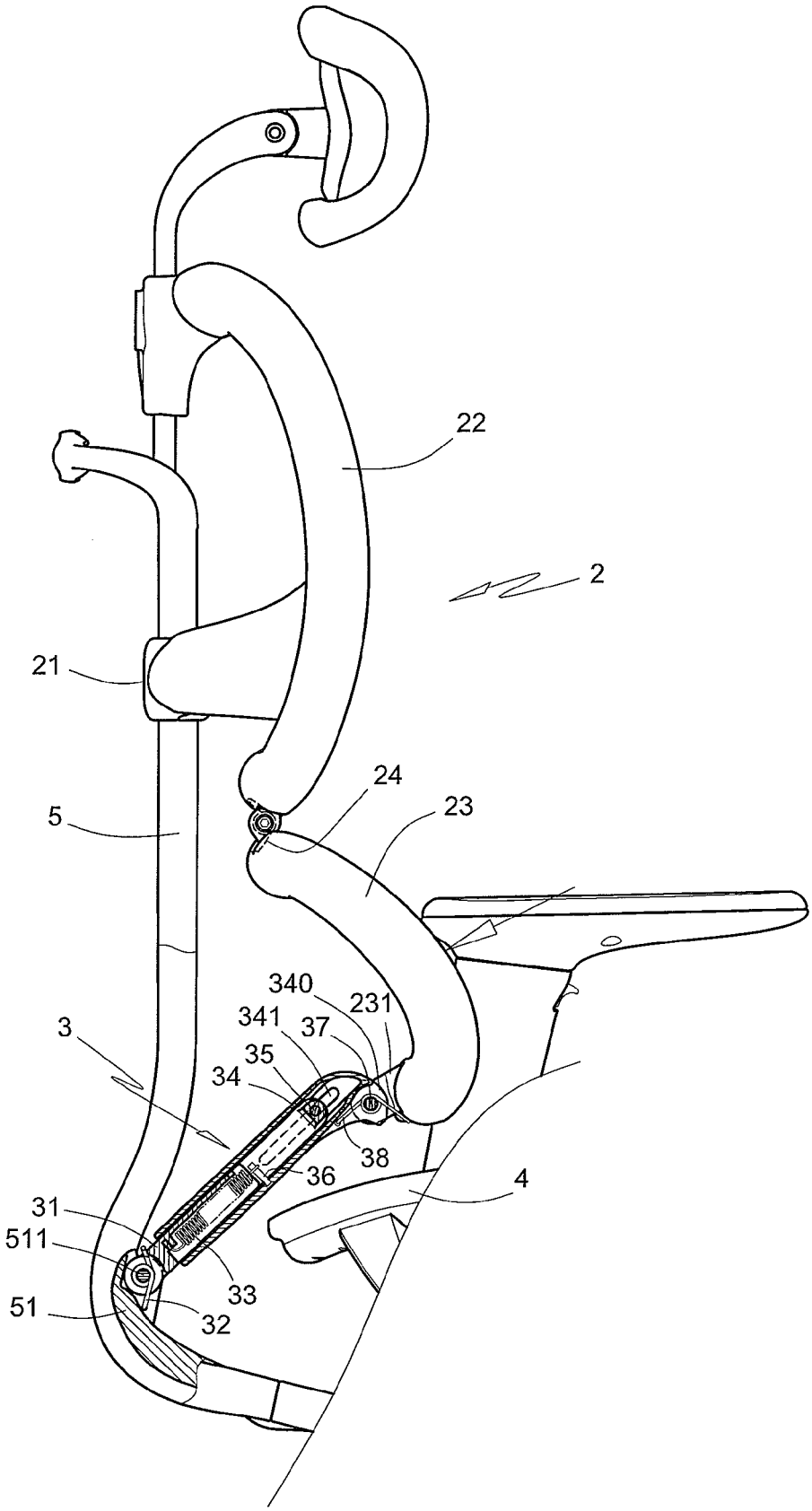
FIG. 6 is a partially sectional view showing the resilient supporting unit of the present invention applied to a different backrest.

While the backrest 2 described above is designed as a single unit, with its lower end formed as the lower-back supporting portion, the backrest 2 may also be divided into an upper- back supporting portion 22 and a lower-back supporting portion 23, as shown in FIG. 6. The lower-back supporting portion 23 is pivotally connected to the lower end of the upper-back supporting portion 22 and is hence allowed to swing freely. A spring 24 is provided where the upper- and lower-back supporting portions 22, 23 are pivotally connected and serves to bias the lower-back supporting portion 23 toward a sitter's lower back. The back of the upper-back supporting portion 22 is slidably connected to the supporting element 5 so that the upper-back supporting portion 22 can move vertically with respect to the supporting element 5 and be secured in position thereto. A pivotal connecting portion 231 is provided at a predetermined position on the back of the lower-back supporting portion 23. The outer ends of the inner and outer supporting rods 31, 34 of the resilient supporting unit 3 are respectively and pivotally connected to the pivotal connecting portions 51, 231. The pivotal connecting portions 51, 231 are also provided with the springs 32, 38, respectively, for the resilient supporting unit 3 to push the lower-back supporting portion 23 resiliently outward, thus allowing the lower-back supporting portion 23 to provide adequate resilient support to the sitter's lower back.

What is claimed is:

1. A resilient lower-back supporting device capable of vertical adjustment along with a backrest of a chair, with the resilient lower-back supporting device comprising:

a supporting element fixed to the chair and to which the backrest is slidably connected and secured in position;

a resilient supporting unit connected between a lower-back supporting portion at a lower end of the backrest and a corresponding position of the supporting element, wherein the resilient supporting unit comprises an outer supporting rod and an inner supporting rod inserted in the outer supporting rod, with the inner and outer supporting rods being extendable and retractable with respect to each other, with the inner supporting rod having a lower end pivotally connected to a predetermined position of the chair, with the outer supporting rod having an upper end pivotally connected to a predetermined position on a back of the backrest; and springs respectively provided where the inner supporting rod and the chair are pivotally connected and where the outer supporting rod and the backrest are pivotally connected, in order to bias the backrest toward a sitter in the chair, wherein the inner supporting rod receives a spring having a lower end attached to the inner supporting rod and an upper end attached to the outer supporting rod.

2. A resilient lower-back supporting device capable of vertical adjustment along with a backrest of a chair, with the resilient lower-back supporting device comprising:

a supporting element fixed to the chair and to which the backrest is slidably connected and secured in position;

a resilient supporting unit connected between a lower-back supporting portion at a lower end of the backrest and a corresponding position of the supporting element, wherein the resilient supporting unit comprises an outer supporting rod and an inner supporting rod inserted in the outer supporting rod, with the inner and outer supporting rods being extendable and retractable with respect to each other, with the inner supporting rod having a lower end pivotally connected to a predetermined position of the chair, with the outer supporting rod having an upper end pivotally connected to a predetermined position on a back of the backrest; and springs respectively provided where the inner supporting rod and the chair are pivotally connected and where the outer supporting rod and the backrest are pivotally connected, in order to bias the backrest toward a sitter in the chair, wherein the outer supporting rod is laterally provided with a slide groove which passes through the outer supporting rod, and wherein an axle passes through the slide groove and an upper end of the inner supporting rod.

3. A resilient lower-back supporting device capable of vertical adjustment along with a backrest of a chair, with the resilient lower-back supporting device comprising:

a supporting element fixed to the chair and to which the backrest is slidably connected and secured in position;

a resilient supporting unit connected between a lower-back supporting portion at a lower end of the backrest and a corresponding position of the supporting element, wherein the resilient supporting unit comprises an outer supporting rod and an inner supporting rod inserted in the outer supporting rod, with the inner and outer supporting rods being extendable and retractable with respect to each other, with the inner supporting rod having a lower end pivotally connected to a predetermined position of the chair, with the outer supporting rod having an upper end pivotally connected to a predetermined position on a back of the backrest; and springs respectively provided where the inner supporting rod and the chair are pivotally connected and where the outer supporting rod and the backrest are pivotally connected, in order to bias the backrest toward a sitter in the chair, wherein the backrest comprises an upper-back supporting portion slidably connected to the supporting element, and wherein the lower-back supporting portion is pivotally connected to a lower end of the upper-back supporting portion.

4. The resilient lower-back supporting device of claim 3, wherein a spring is provided where the upper- and lower-back supporting portions are pivotally connected, in order to bias the lower-back supporting portion toward a predetermined direction.

* * * * *